United States Patent [19]

Kageyama et al.

[11] 3,974,417

[45] Aug. 10, 1976

[54] FOUR-CAVITY VELOCITY MODULATION TUBE

[75] Inventors: Takao Kageyama; Hiroshi Kato, both of Tokyo, Japan

[73] Assignee: Nippon Electric Company, Ltd., Tokyo, Japan

[22] Filed: Nov. 25, 1975

[21] Appl. No.: 635,178

[30] Foreign Application Priority Data

Dec. 6, 1974 Japan ..... 49-140854

[52] U.S. Cl. ..... 315/5.43; 315/5.39; 315/5.52

[51] Int. Cl.[2] ..... H01J 25/10

[58] Field of Search ..... 315/5.41, 5.43, 5.51, 315/5.52, 5.39

[56] References Cited

UNITED STATES PATENTS

| | | | |
|---|---|---|---|
| 2,579,480 | 12/1951 | Feenberg | 315/5.43 |
| 3,195,007 | 7/1965 | Watson et al. | 315/5.43 |
| 3,622,834 | 11/1971 | Lien | 315/5.52 |
| 3,725,721 | 4/1973 | Levin | 315/5.43 |
| 3,775,635 | 11/1973 | Faillon et al. | 315/5.43 |
| 3,811,065 | 5/1974 | Lien | 315/5.43 |
| 3,819,977 | 6/1974 | Kageyama | 315/5.43 |
| 3,904,917 | 9/1975 | Ueda | 315/5.52 |

*Primary Examiner*—Saxfield Chatmon, Jr.
*Attorney, Agent, or Firm*—Ostrolenk, Faber, Gerb & Soffen

[57] ABSTRACT

In a four-cavity velocity modulation tube comprising an electron gun assembly, an input cavity, a pre-intermediate cavity, a post-intermediate cavity, an output cavity, a collector assembly and drift tubes interposed between adjacent ones of said cavities, said input cavity is tuned to the proximity of the lower end of the operating passband of said velocity modulation tube, said pre-intermediate cavity is tuned to the proximity of the upper end frequency of said operating passband, said post-intermediate cavity is tuned to a fundamental resonant frequency that is higher than the upper end frequency of said operating passband but lower than a frequency which is 1.6 times as high as the center frequency of said operating passband, the normalized length of all of said drift tubes being smaller than 90 degrees in terms of the reduced plasma angle, and the normalized length of the drift tube positioned between said pre-intermediate cavity and said post-intermediate cavity being larger than the normalized lengths of the other drift tubes.

6 Claims, 6 Drawing Figures

FOUR-CAVITY VELOCITY MODULATION TUBE

BACKGROUND OF THE INVENTION

The present invention relates to a highly efficient four-cavity velocity modulation tube of reduced size and especially of reduced overall axial length.

In a multicavity velocity modulation tube, the respective cavities are tuned to mutually different frequencies within the operating passband to optimize the gain versus frequency characteristics. In conventional four-cavity velocity modulation tubes, the input cavity is tuned to the center frequency of the operating passband or to a frequency higher than the center frequency, while the pre-intermediate cavity disposed downstream of and next to the input cavity is tuned to a frequency lower than the center frequency. For details of the tube of this type, reference is made to K. H. Kreuchen, B. A., Auld and N. E. Dixon, "A Study of the Broadband Frequency Response of the Multicavity Klystron Amplifier" (Journal of Electronics, Vol. 2, p.p. 529–567; May 1957) and Tatsuo Hayashi "UHF-TELEVISION SOCHIN TO JUSHIN (Transmission and Reception of UHF-Television)" (DENPA SHINBUN SHUPPANBU January 1970, p. 272: written in Japanese). Accordingly, in the proximity of the center frequency of the operating passband, the phase of the voltage induced across the gap space within the pre-intermediate cavity is kept almost out-of-phase with respect to the gap voltage within the input cavity, so that debunching effects may possibly occur in the electron beam which has undergone bunching once. Also, in the prior art the Q-value of the cavity is higher in the pre-intermediate cavity than in the input cavity. In addition, with regard to the drift tube lengths of a velocity modulation tube of a reduced overall length, the normalized length of the first drift tube disposed downstream of the input cavity is set, with the power gain in view, at about 70° in terms of the reduced plasma angle because the level of the radio frequency voltage generated across the gap space within the input cavity is deemed as a small signal that is sufficiently small relative to a D.C. beam voltage (Reference is made to S. E. Webber "Ballistic Analysis of a Two-Cavity Finite Beam Klystron", IRE Trans. on Electron Devices, Vol. ED–5, p.p. 98–108: April 1958). Since the levels of the voltages respectively generated across the gap spaces within the pre-intermediate and post-intermediate cavities are sufficiently high, normalized lengths of second and third downstream drift tubes are set at about 40° and 25°, respectively, depending upon the levels of the voltages induced across the cavity gap spaces. The above-mentioned arrangement of drift tube lengths is effective when bunchings in an electron beam are successively and cumulatively achieved. However, since debunching occurs at the gap space in the pre-intermediate cavity, a normalized length of about 40° for the second drift tube is not sufficient for the once debunched electrons to be rebunched. For these reasons, conventional four-cavity velocity modulation tubes have a limited saturation output efficiency of 30 to 40%.

It is to be noted here that a normalized length of a drift tube as represented in terms of the reduced plasma angle is given by $\omega q/Uo\ l$, where $\omega q$ (radian/-second) represents the reduced plasma angular-frequency, $Uo$ represents the D.C. beam velocity, and $l$ represents the physical length of the drift tube as measured between the centers of the gap spaces.

As described in Japanese Patent Application No. 24221/71, laid open to public inspection as a Japanese Patent Disclosure corresponding to U.S. application Ser. No. 28,792 now U.S. Pat. No. 3,622,834, the conversion efficiency of multicavity velocity modulation tubes can be improved by inserting a drift tube of a normalized length of 120° between the post-intermediate cavity and the pre-intermediate cavity located just upstream thereof to allow electrons lying in the area between the centers of bunches to be shifted toward the respective bunching centers by the electrostatic force attributed to the second harmonic space charge generated in the electron beam, thereby strongly bunching the electrons. However, this method, based on the electrostatic force exerted by the harmonic space charge, requires an extraordinarily long drift tube of a normalized length of 120°. As a result, overall length of the tube becomes inevitably larger than conventional tubes having ordinary drift tubes whose normalized lengths are 90° or less.

Therefore, such a velocity modulation tube based on the second-harmonics-space-charge-exerting force does harm rather than making a positive contribution to the manufacture of samll-sized UHF-TV broadcast transmitters.

Furthermore, the operating frequency range and D.C. beam voltage ranges of the tube satisfying the condition of 120° in normalized length are extremely limited.

On the other hand, with respect to conventional velocity modulation tubes having normalized lengths of 90° or less, the conversion efficiency can be increased by making the drift length large enough to eliminate debunching without resorting to the bunching effect of the second harmonics or by undertaking appropriate tuning of the respective cavities. For further details of this technique, reference is made to U.S. Pat. No. 3,819,977 and copending U.S. Pat. application Ser. No. 552,436 filed Feb. 24, 1975, now U.S. Pat. No. 3,942,066 which application is a continuation-in-part application of U.S. application Ser. No. 408,186 filed Oct. 19, 1973, now abandoned. As is fully described in these prior specifications, this technique, when applied to a five-cavity velocity modulation tube, yields a saturation conversion efficiency of as high as 60%. However, compared with the four-cavity velocity modulation tube, the five-cavity-type tube has one excessive cavity resonator, and consequently is larger in overall length, more costly to manufacture and more difficult to adjust for optimized operation.

On the other hand, the demand has recently risen for high efficiency four-cavity velocity modulation tubes of the output cavity type and having a power output of as high as 20 KW but of moderate power gain, particularly because the improvement in transistor technology has made it possible for the exciter circuits to provide sufficiently high driving signal levels. Under the circumstances, the mere application of the cited technique (U.S. patent Appln. Ser. No. 552,436 now U.S. Pat. No. 3,942,066 referred to above) to the four-cavity velocity modulation tube does not lead to the result desired. More specifically, even though the conversion efficiency might be improved to a level of 40% to 55% by reducing the lengths of the drift tubes in proportion to the radio frequency voltages induced across the cavity gap spaces, a conversion efficiency of 60% or more, which can be realized with the five-cavity tubes, is very difficult to attain without appreciably affecting (i.e., reducing) the operational passband.

SUMMARY OF THE INVENTION

It is therefore, one object of the present invention to provide a high efficiency four-cavity velocity modulation tube having a sufficiently broad operating passband and an appreciably reduced overall length, and which can realize a high conversion efficiency.

According to one feature of the present invention, there is provided an improved four-cavity velocity modulation tube comprising an input cavity, one pre-intermediate cavity, one post-intermediate cavity disposed downstream of said pre-intermediate cavity, an output cavity serving as output circuit means, and a plurality of drift tubes disposed between adjacent ones of said cavities, in which the normalized length of the drift tube between the pre-intermediate cavity and the post-intermediate cavity is larger than the normalized lengths of other drift tubes. To improve the gain versus frequency characteristics of the tube, the input cavity is tuned to a fundamental resonant frequency in the proximity of the lower band edge, while the pre-intermediate cavity is tuned to the proximity of the upper band edge, and the post-intermediate cavity is tuned to a fundamental resonant frequency considerably higher than the upper band edge. Also, to improve the gain versus frequency characteristics, the Q-value of the pre-intermediate cavity is selected to be equal to or lower than the Q-value of the input cavity.

The debunching caused by the fundamental frequency within the operating frequency range is completely eliminated by tuning the pre-intermediate cavity and the post-intermediate cavity to a relatively high frequency. It is therefore, contemplated to obtain highly dense bunching in the output cavity gap space by successively and cumulatively achieving the bunching of the electron beam that has been velocity modulated by the input cavity gap voltage. Also, the cumulative effect of the bunching is enhanced by adjusting the normalized length of the drift tube between the pre-intermediate cavity and the post-intermediate cavity to be the greatest of all the drift tubes. Thus, a high conversion efficiency is attained despite the short overall length of the tube. The difference in the bunching cumulative effect caused by the difference in length distribution of the drift tubes will be discussed later in more detail with reference to the large signal operation of a four-cavity velocity modulation tube.

DESCRIPTION OF THE PREFERRED EMBODIMENTS

Figure 1:
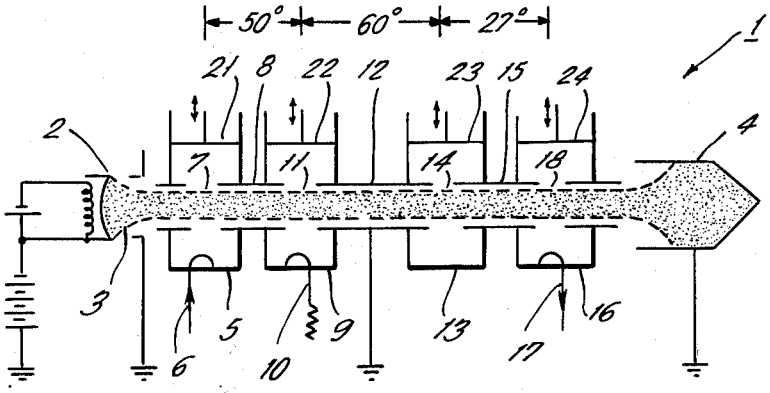
FIG. 1 is a schematic view of a four-cavity velocity modulation tube according to the present invention.

The present invention will now be described with reference to the accompanying drawings. In FIG. 1 is shown one example of a velocity modulation tube having the features of the present invention. In this Figure, tube 1 includes an electron gun assembly 2 for forming and ejecting an electron beam 3 towards a collector electrode 4 disposed at a terminal end of a long beam path. A reentrant-type input cavity 5 is disposed at the upstream end of the electron beam 3 for the excitation by radio frequency energy supplied through an input coupling loop 6. In addition, the cavity 5 has its resonant frequency tuned to the proximity of the lower band edge by adjusting means for varying a resonant frequency provided in the cavity such as, for example, a tuning end plate 21. Also, the cavity 5 includes a gap space 7 defined between free end portion of the reentrant cavity. A radio frequency voltage $V_1$, generated across the gap space 7 interacts with electron beam 3 to velocity-modulate the beam. A first drift tube 8 surrounds the electron beam 3 in the region downstream of the input cavity 5 to provide a radio frequency field-free region within which the electrons may drift with velocities imparted to the electrons by the velocity modulation imposed by the gap space 7. As a result, when the electron beam 3 passes through the gap space 11 within a pre-intermediate cavity 9, a density-modulated current of a fundamental wave is seen in the electron beam 3, which wave has a phase delayed by about 90° with respect to the voltage induced across the gap space 7. This density modulated electron beam 3 excites the pre-intermediate cavity 9 and induces in the cavity wall a current substantially in phase with the density-modulated current of the fundamental wave. Assuming now that the pre-intermediate cavity 9 is tuned to the proximity of the upper end frequency of the operating passband by adjusting the resonant frequency varying means 22, then the impedance of the pre-intermediate cavity 9, as viewed from the gap space 11 at the center frequency of the operating passband, is inductive. Therefore, the induced current flowing in the cavity wall generates across the gap space 11 a radio frequency voltage $V_2$ having an advanced phase with respect to the induced current. As a result, the electron beam 3 bunched within the region of the first drift tube 8, is subjected to velocity modulation such that a bunching effect may be further cumulated within the gap space 11. In addition, the pre-intermediate cavity 9 is provided with coupling means 10 such as a loop for connecting a resistance element for the purpose of adjusting the Q-value of the cavity.

Since the second drift tube 12 has a larger normalized length (represented in terms of the reduced plasma angle) than the first drift tube 8 or the third drift tube 15, the electron beam 3 can be subjected to a large cumulative bunching effect within this region.

A post-intermediate cavity 13 is a reentrant cavity having a gap space 14 for interacting with the electron beam 3. Since this post-intermediate cavity 13 is tuned to a fundamental frequency higher than the upper end frequency of the operating passband of the tube, but lower than a frequency which is 1.6 times as high as the center frequency of the operating passband, by adjusting resonant frequency varying means 23, the impedance of the post-intermediate cavity 13, as viewed from the gap space 14 at the proximity of the center frequency of the operating passband, is sufficiently inductive. Therefore, similar to the pre-intermediate cavity 9, the phase of the radio frequency voltage $V_3$ generated across the gap space 14 in the post-intermediate cavity 13 as excited by the density-modulated current, is substantially in an in-phase relationship with the voltages $V_1$ and $V_2$ generated across the gap spaces 7 and 11, respectively, so that the electron beam 3 which has been cumulatively bunched in the region of the second drift tube 12, subjected to velocity modulation in the gap space 14 in such a manner that the bunching effected by that time may be further enhanced. To increase the power gain of the tube, the post-intermediate cavity 13 should be tuned to a fundamental frequency higher than the upper band edge but lower than a frequency which is 1.2 times as high as the center frequency of the operating passband.

Finally, a reentrant output cavity 16 is disposed downstream of the preceding post-intermediate cavity 13. This output cavity 16 is provided with a gap space 18 for interacting with the electron beam 3 and is tuned to the proximity of the center frequency of the operating frequency range by adjusting resonant frequency varying means 24. The density-modulated electron beam 3 excites the output cavity 16, and output energy is extracted via coupling means 17 which may, for example, be a coupling loop.

In the illustrated embodiment, the normalized lengths of the drift tubes 8, 12 and 15 are 50°, 60° and 27°, respectively, so that the overall length of the tube 1 may be shortened and a high conversion efficiency may be obtained.

Figure 2:
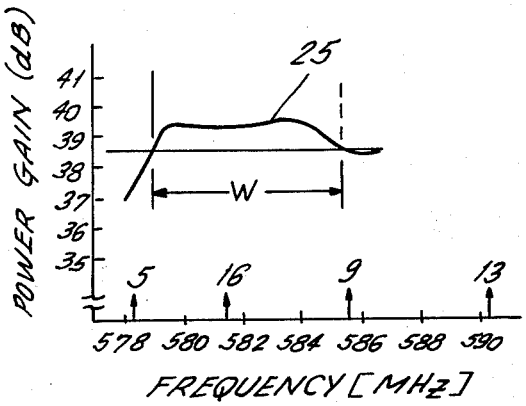
FIG. 2 is a diagram representing a power gain (dB) versus frequency (MHz) characteristic curve of the tube in FIG. 1 and showing the resonant frequencies of the respective cavities.

A curve 25 shown in FIG. 2 represents gain versus frequency characteristics of the tube illustrated in FIG. 1, the center frequency of the operating passband being 582 MHz, with the respective cavities 5, 9, 13 and 16 being tuned to the frequencies indicated by arrows designated by the same reference numerals so that the operational frequency bandwidth [W] as defined by the points on the gain characteristic curve, which are 1 dB lower than the point of the maximum gain, may be about 6 MHz. In other words, the input cavity 5 is tuned to a frequency slightly lower than the lower band edge, while the pre-intermediate cavity 9 is tuned to a frequency slightly higher than the upper band edge. On the other hand, the post-intermediate cavity 13 is tuned to a frequency that is considerably higher than the upper band edge, and the output cavity 16 is tuned to a frequency substantially equal to the center frequency of the operating passband. Furthermore, with regard to the loaded Q-value of the cavities in this embodiment, the Q-value of the pre-intermediate cavity 9 is set lower than that of the input cavity to improve the gain versus frequency characteristics. More particularly, the loaded Q-value of the respective cavities are adjusted to: $Q = 160$ at the input cavity 5 including the input coupling means 6; $Q = 130$ at the pre-intermediate cavity 9 including the coupling means 10 for connecting a resistance element of 50 ohms; $Q = 700$ at the post-intermediate cavity 13 without employing special coupling means; and $Q = 77$ at the output cavity 16 including the output coupling means 17.

Figure 3:
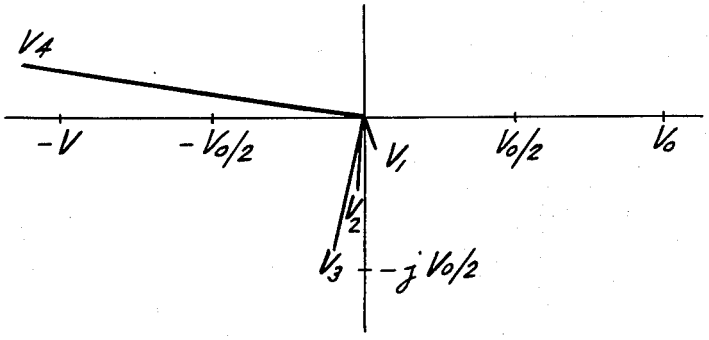
FIG. 3 is a vector diagram representing radio frequency voltages generated across the respective cavity gap spaces of the tube in FIG. 1.

FIG. 3 is a vector representation of the radio frequency voltages $V_2$, $V_3$ and $V_4$ generated across the gap spaces in the cavities other than the input cavity 5 with reference to the gap voltage $V_1$ in the input cavity 3. As will be apparent from this Figure, with respect to the voltage $V_1$ generated across the gap space 7 in the input cavity 5, the voltages $V_2$ and $V_3$ generated across the subsequent gap spaces 11 and 14, respectively, are substantially in an in-phase relationship. On the other hand, since the phase of the voltage $V_4$ generated across the gap space 18 in the output cavity 16 is offset by about 90° with respect to these voltages, the voltage $V_4$ serves to decelerate the electron beam 3 to extract output wave energy. In this Figure, a scale value $Vo$ represents the D.C. beam voltage.

Figure 4:
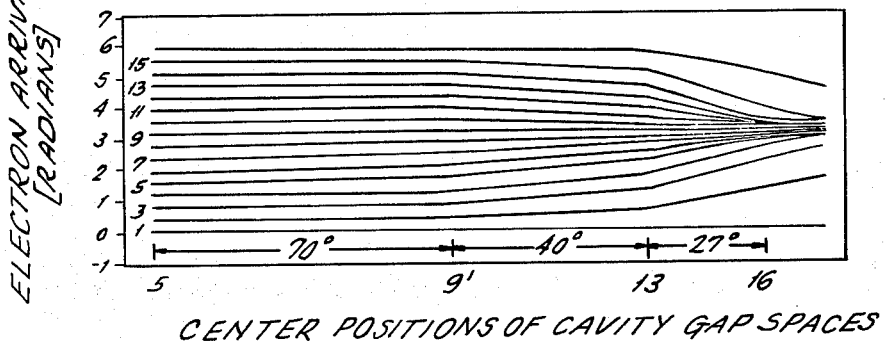
FIG. 4 is an electron phase diagram of a tube according to the prior art design.
Figure 5:
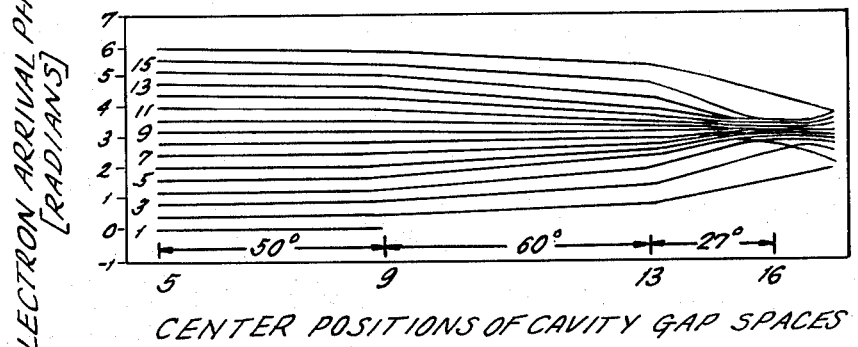
FIG. 5 is an electron phase diagram of the tube shown in FIG. 1.
Figure 6:
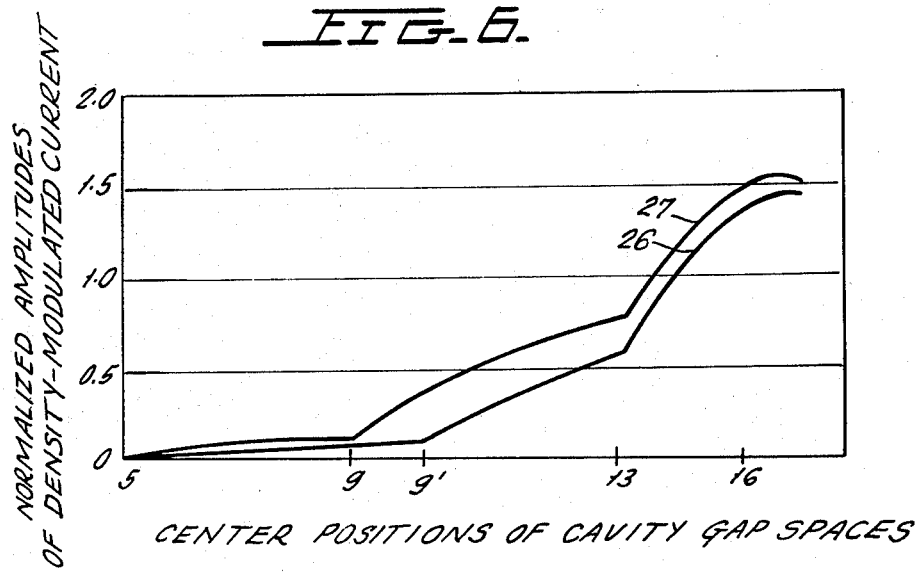
FIG. 6 is a diagram representing normalized magnitudes of the fundamental component of the density modulation current as a function of a distance along the beam path for the purpose of comparing the tube in FIG. 1 with the tube according to the prior art design.

Now the difference in the cumulative bunching effect caused by the difference in the distribution of the drift tube lengths, will be described with reference to the results of computer simulation for a large signal operation of four-cavity velocity modulation tubes as represented in FIGS. 4, 5 and 6. In FIG. 4, are shown electron arrival phases (in radians) of 16 representative electrons taken in one period of the signal frequency at the center positions of the cavity gap spaces taken along a beam path of a velocity modulation tube having the same overall length as the tube shown in FIG. 1 and having distribution of the drift tube lengths found in the prior art. The electron phase angles were taken relative to a reference electron moving at a D.C. velocity of the electron beam. From this Figure, it is seen that the cumulative bunching effect is small because the normalized length of the second drift tube is as short as 40°, and that the velocity deviation in the bunching obtained at the output gap space is large. FIG. 5 shows electron arrival phases (in radians) of 16 representative electrons at the center positions of the cavity gap spaces taken along the beam path of the tube shown in FIG. 1. From this Figure it is seen that desirable bunching having a little velocity deviation can be obtained at the output gap space because the normalized length of the second drift tube is as long as 60°. It is to be noted that the positions designated by reference numerals 5, 9, 13 and 16 represent the center positions of the gap spaces in the respective cavities designated by like reference numerals in FIG. 1, taking the center position of the input cavity gap space 7 at the origin. Reference numeral 9' in FIG. 4 represents the center position of the pre-intermediate cavity gap space in the tube according to the prior art design.

FIG. 6 shows the comparison of the normalized amplitudes, as represented by D.C. currents, of the fundamental components of the density-modulated currents in the electron beams between the tube according to the present invention illustrated in FIG. 1 and a velocity modulation tube according to the prior art design and having the same overall length as the tube in FIG. 1, as a function of distance measured along the beam path. In this Figure, the positions designated by reference numerals 5, 9, 9', 13 and 16 correspond to the positions represented by the same reference numerals in FIGS. 4 and 5. Curve 26 represents the value of the density-modulated current in the tube according to the prior art design, whereas curve 27 represents the value of the density-modulated current in the tube according to one preferred embodiment of the present invention illustrated in FIG. 1. From this Figure, it is seen that according to the present invention, in contrast to the prior art design, since the normalized length of the second drift tube is increased and thereby the cumulative bunching effect in this section in enhanced, a large density-modulated current is obtained at the output cavity gap space, so that the conversion efficiency can be improved by about 7% over prior art tubes.

While the present invention has been described above in conjunction with a four-cavity velocity modulation tube, it is equally applicable to the case where the above-mentioned post-intermediate cavity is formed of a plurality of cavities cascaded along drift tubes. In such an arrangement, the normalized length of the drift tube between the pre-intermediate cavity and the post-intermediate cavity of a post-intermediate cavity group, disposed in the immediate neighborhood of the pre-intermediate cavity, is made longer than the normalized length of all the other drift tubes, and each one of the plurality of cavities forming the post-intermediate cavity is tuned to a fundamental resonant frequency higher than the upper end frequency of the operating passband. In addition, it is to be noted that the cavities to be used in the velocity modulation tube according to the present invention are not limited to the single gap type of reentrant cavity as employed in the illustrated embodiment, but alternatively may be constructed of a plurality of extended interaction resonators such as helical resonators.

What is claimed is:

1. A velocity modulation tube of at least four cavities having a predetermined operating passband, characterized in that said tube comprises;

an electron beam source and a beam collector spaced therefrom;

an input cavity tuned to the proximity of the lower end frequency of said operating passband and positioned between said source and said collector;

one pre-intermediate cavity disposed downstream of said input cavity along the electron beam path and tuned to the proximity of the upper end frequency of said operating passband;

one post-intermediate cavity disposed downstream of said pre-intermediate cavity along the electron beam path and tuned to a fundamental resonant frequency that is higher than the upper end frequency of said operating passband but lower than a frequency which is 1.6 times as high as the center frequency of said frequency band;

an output cavity disposed downstream of said post-intermediate cavity on the electron beam path for extracting output wave energy from a density-modulated electron beam, and a plurality of drift tubes interposed between said four cavities;

the normalized length of each one of said drift tubes being smaller than 90° in terms of the reduced plasma angle, and the normalized length of the drift tube between said pre-intermediate cavity and said post-intermediate cavity being larger than the normalized lengths of the other drift tubes.

2. A four-cavity velocity modulation tube as claimed in claim 1, in which each said cavity includes means for adjustably varying its resonant frequency.

3. A four-cavity velocity modulation tube as claimed in claim 2, in which said output cavity is tuned to a frequency in the proximity of the center of said predetermined operating passband.

4. A four-cavity velocity modulation tube as claimed in claim 3, in which said post-intermediate cavity is tuned to a fundamental resonant frequency that is higher than the upper end frequency of said operating passband but lower than a frequency which is 1.2 times as high as the center frequency of said operating passband.

5. A four-cavity velocity modulation tube as claimed in claim 1, in which the Q-value of said pre-intermediate cavity is equal to or less than the Q-value of said input cavity.

6. A four-cavity velocity modulation tube as claimed in claim 5, in which said tube comprises means for adjusting the Q-value or Q-values of at least said pre-intermediate cavity.

* * * * *